US012733690B2

(12) United States Patent
Hamada et al.

(10) Patent No.: US 12,733,690 B2
(45) Date of Patent: Sep. 15, 2026

(54) NON-HEATING TYPE FLAVOR COMPONENT EMISSION DEVICE, NON-HEATING TYPE FLAVOR INHALER, AND NON-HEATING TYPE FLAVOR SUSTAINED-RELEASE DEVICE

(71) Applicant: SHARP KABUSHIKI KAISHA, Sakai City (JP)

(72) Inventors: Hiroka Hamada, Sakai City (JP); Tsuyoshi Kamada, Sakai City (JP); Tetsuya Ide, Sakai City (JP); Masakazu Kamura, Sakai City (JP); Sho Ochi, Sakai City (JP); Kyoko Matsuura, Sakai City (JP); Satoru Motonami, Sakai City (JP); Yuusuke Shimizu, Sakai City (JP)

(73) Assignee: SHARP KABUSHIKI KAISHA, Sakai City (JP)

( * ) Notice: Subject to any disclaimer, the term of this patent is extended or adjusted under 35 U.S.C. 154(b) by 431 days.

(21) Appl. No.: 18/574,921

(22) PCT Filed: May 18, 2022

(86) PCT No.: PCT/JP2022/020598
§ 371 (c)(1),
(2) Date: Dec. 28, 2023

(87) PCT Pub. No.: WO2023/007912
PCT Pub. Date: Feb. 2, 2023

(65) Prior Publication Data

US 2024/0298717 A1 Sep. 12, 2024

(30) Foreign Application Priority Data

Jul. 26, 2021 (JP) ..... 2021-121774

(51) Int. Cl.
*A24F 42/20* (2020.01)
*A24F 42/60* (2020.01)

(52) U.S. Cl.
CPC ..... *A24F 42/20* (2020.01); *A24F 42/60* (2020.01)

(58) Field of Classification Search
CPC ..... A24F 42/20
See application file for complete search history.

(56) References Cited

U.S. PATENT DOCUMENTS 5,936,178 A * 8/1999 Saari ..... G10D 3/00 84/453
2021/0112855 A1 4/2021 Watanabe

FOREIGN PATENT DOCUMENTS

EP 3744186 A1 * 12/2020 ..... B65D 81/2076
WO WO-2014156537 A1 * 10/2014 ..... A61M 15/06
WO 2019/220904 A1 11/2019

OTHER PUBLICATIONS

WO-2014156537-A1, English machine translation (Year: 2014).*

* cited by examiner

*Primary Examiner* — Michael H. Wilson
*Assistant Examiner* — Michael T Fulton
(74) *Attorney, Agent, or Firm* — ScienBiziP, P.C.

(57) ABSTRACT

A non-heating type flavor component emission device includes: a hollow casing provided with a first opening, a second opening, and a flow path guiding an air flow from the first opening to the second opening; a water retainer disposed in the flow path, retaining water, and emitting the water into the air flow; and an emitter disposed in the flow path closer to the second opening than to the water retainer, and emitting a flavor component into the air flow. The emitter includes: an absorber containing a water absorbing material; a moisture control component containing salt that forms hydrate crystals within a relative humidity range of 30% RH or more and 80% RH or less, the moisture control component being contained in the water absorbing material, and absorbing and emitting water; and the flavor component.

13 Claims, 14 Drawing Sheets

NON-HEATING TYPE FLAVOR COMPONENT EMISSION DEVICE, NON-HEATING TYPE FLAVOR INHALER, AND NON-HEATING TYPE FLAVOR SUSTAINED-RELEASE DEVICE

TECHNICAL FIELD

The present disclosure relates to a non-heating type flavor component emission device, a non-heating type flavor inhaler, and a non-heating type flavor sustained-release device. The present application claims priority from Japanese Patent Application JP2021-121774 filed on Jul. 26, 2021, the content of which is hereby incorporated by reference into this application.

BACKGROUND ART

A conventionally available combustible tobacco product combusts to form sidestream smoke that affects the surroundings of a smoker. Furthermore, a heating-type tobacco product available in recent years needs a battery to form steam. In contrast, a non-heating-type tobacco product does not either produce sidestream smoke nor need a battery.

Patent Document 1 discloses an aromatic cartridge. In the aromatic cartridge, a heat producing body produces heat to generate smoke and a flavor component in the form of an aerosol (paragraph [0101]).

CITATION LIST

Patent Literature

Patent Document 1: WO 2019/220904

SUMMARY

Technical Problems

A flavor component emission device included in a non-heating-type tobacco product fails to emit a desirable flavor component. Hence, the non-heating-type tobacco product cannot provide a sense of sufficient satisfaction to smokers.

The present disclosure is devised to overcome the above problems. The present disclosure is set out to provide a non-heating type flavor component emission device, a non-heating type flavor inhaler, and a non-heating type flavor sustained-release device, all of which emit a desirable flavor component.

Solution to Problems

A non-heating type flavor component emission device according to an aspect of the present disclosure includes: a hollow casing provided with a first opening, a second opening, and a flow path guiding an air flow from the first opening to the second opening; a water retainer disposed in the flow path, retaining water, and emitting the water into the air flow; and an emitter disposed in the flow path closer to the second opening than to the water retainer, and emitting a flavor component into the air flow. The emitter includes: an absorber containing a water absorbing material; a moisture control component containing salt that forms hydrate crystals within a relative humidity range of 30% RH or more and 80% RH or less, the moisture control component being contained in the water absorbing material, and absorbing and emitting water; and the flavor component.

A non-heating type flavor inhaler according to another aspect of the present disclosure includes: the non-heating type flavor component emission device according to an aspect of the present disclosure; and a cylindrical holder provided with an inlet through which the air flow enters, an outlet through which the air flow exits, and a housing space extending from the inlet to the outlet and housing the non-heating type flavor component emission device. The cylindrical holder includes a mouthpiece portion provided with the outlet.

A non-heating type flavor sustained-release device according to still another aspect of the present disclosure includes: the non-heating type flavor component emission device according to an aspect of the present disclosure; a cylindrical holder provided with an inlet through which the air flow enters, an outlet through which the air flow exits, and a housing space extending from the inlet to the outlet and housing the non-heating type flavor component emission device; and a forming mechanism disposed along the inlet or the outlet, and forming the air flow.

DESCRIPTION OF EMBODIMENTS

An embodiment of the present disclosure will be described below, with reference to the drawings. Note that, throughout the drawings, like reference signs denote identical or similar constituent features. Such features will not be repeatedly elaborated upon.

1. First Embodiment

1.1 Non-Heating Type Flavor Component Emission Device

Figure 1:
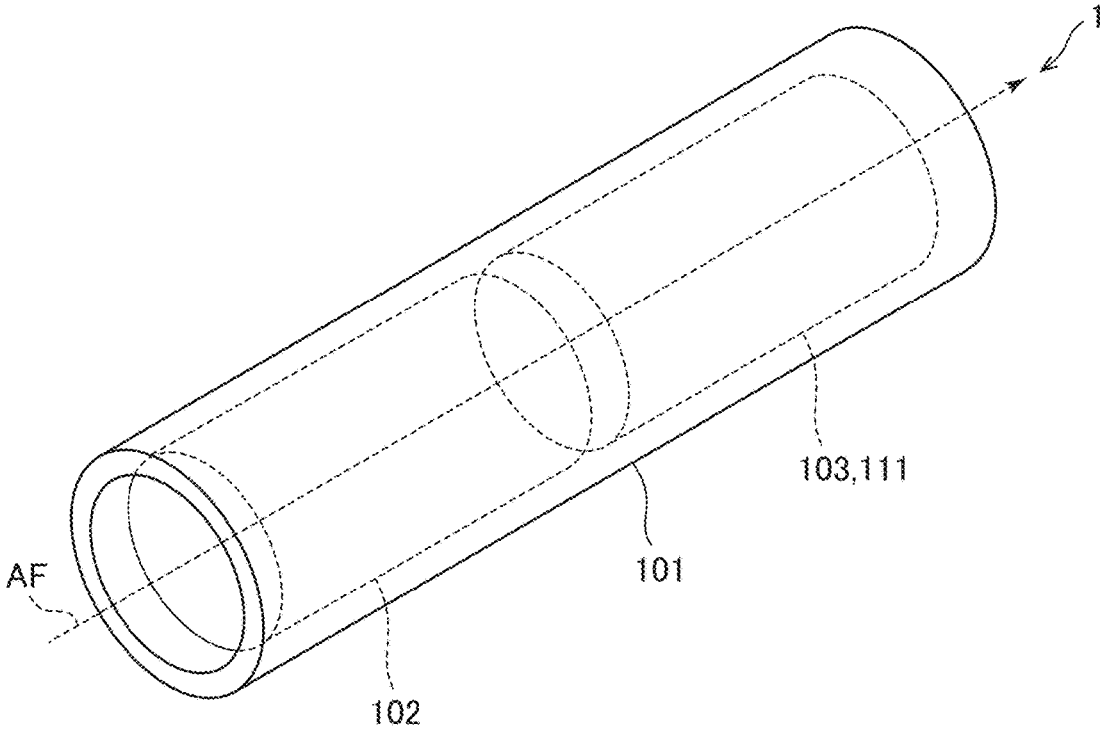
FIG. 1 is a perspective view schematically illustrating a non-heating type flavor component emission device of a first embodiment.
Figure 2:
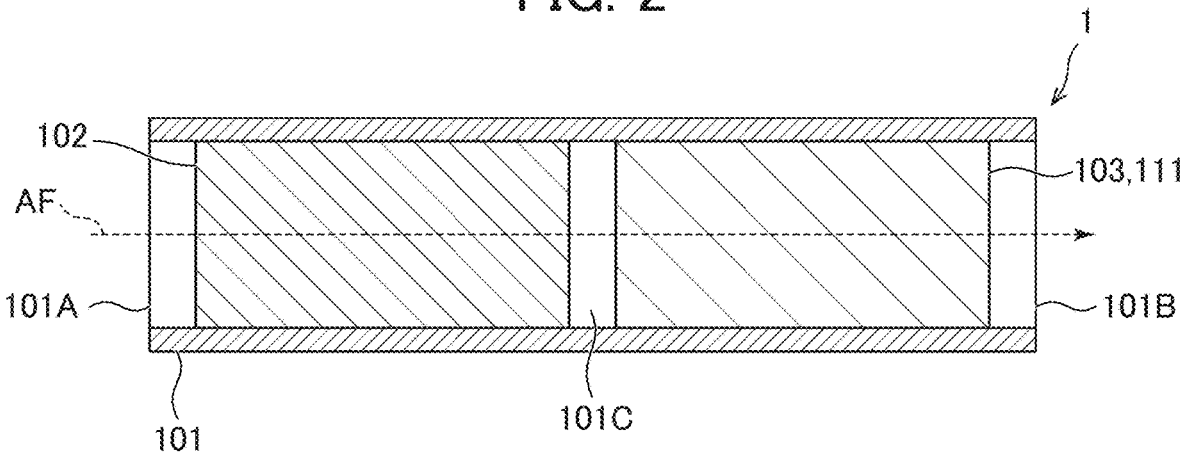
FIG. 2 is a cross-sectional view schematically illustrating the non-heating type flavor component emission device of the first embodiment.

FIG. 1 is a perspective view schematically illustrating a non-heating type flavor component emission device of a first embodiment. FIG. 2 is a cross-sectional view schematically illustrating the non-heating type flavor component emission device of the first embodiment.

A non-heating type flavor component emission device 1 of the first embodiment illustrated in FIGS. 1 and 2 transmits an air flow AF, and emits a flavor component into the air flow AF to be transmitted. The non-heating type flavor component emission device 1 is attached to, and detached from, a main body of such a device as a non-heating type flavor inhaler or a non-heating type flavor sustained-release device. The non-heating type flavor inhaler is also referred to as a non-heating type tobacco product. The non-heating type flavor sustained-release device is also referred to as a non-heating type aromatic agent. The air flow AF is formed when the air is inhaled or blown.

As illustrated in FIGS. 1 and 2, the non-heating type flavor component emission device 1 includes: a hollow casing 101; a water retainer 102; and an emitter 103.

The hollow casing 101 has a cylindrical shape. Hence, the hollow casing 101 is provided with a first opening 101A, a second opening 101B, and a flow path 101C.

The flow path 101C extends from the first opening 101A to the second opening 101B. Hence, the air flow AF enters the flow path 101C through the first opening 101A. Then, the air flow AF is guided by the flow path 101C from the first opening 101A to the second opening 101B, and exits the flow path 101C through the second opening 101B.

The water retainer 102 is disposed in the flow path 101C. The water retainer 102 is capable of transmitting the air flow AF. The water retainer 102 retains water, and emits the retained water into the transmitted air flow AF. When the water retainer 102 retains water, the user conducts such a work as immersing the water retainer 102 in the water.

The emitter 103 is disposed in the flow path 101C. The emitter 103 can transmit the air flow AF. The emitter 103 emits a flavor component into the air flow AF to be transmitted. The emitter 103 is disposed closer to the second opening 101B than to the water retainer 102. Hence, the emitter 103 is disposed downstream of the air flow AF from the water retainer 102.

As FIGS. 1 and 2 illustrate, the emitter 103 is made of an emission material 111 formed into a single piece.

The emission material 111 emits the flavor component into the air flow AF.

The emission material 111 is formed of a material containing water. A moisture content of the material varies, depending on a relative humidity of the ambient air of the emission material 111. An equilibrium moisture content of the emission material 111 changes in accordance with the relative humidity of the ambient air, and reaches a stable state. The equilibrium moisture content is synonymous with a moisture absorptivity. The emission material 111 has a threshold humidity. The emission material 111 emits the flavor component into the ambient air of the emission material 111 if the relative humidity of the ambient air of the emission material 111 is higher than the threshold humidity of the emission material 111. The emission material 111 keeps from emitting the flavor component into the ambient air of the emission material 111 if the relative humidity of the ambient air of the emission material 111 is lower than the threshold humidity of the emission material 111. The threshold humidity of the emission material 111 can be adjusted by the material of the emission material 111. An amount of the flavor component sustained-released from the emission material 111 can be controlled by the relative humidity of the ambient air of the emission material 111.

In the initial state, the water retainer 102 has a high relative humidity. Furthermore, the emitter 103 has a relative humidity lower than the threshold humidity of the emitter 103.

The water retainer 102 transmits the air flow AF, emits water into the air flow AF to be transmitted, and forms the air flow AF having a high relative humidity.

The emitter 103 transmits the formed air flow AF, absorbs the moisture contained in the air flow AF to be transmitted, emits the flavor component into the air flow AF to be transmitted after the relative humidity rises above the threshold humidity, and generates the air flow AF containing the flavor component.

Thanks to such features, the non-heating type flavor component emission device 1 emits a desirable flavor component. For example, the non-heating type flavor component emission device 1 can emit a flavor component in sufficient amount satisfactory to the user.

Furthermore, the non-heating type flavor component emission device 1 can cause the emitter 103 to emit the flavor component when the emitter 103 is simply brought into contact with the air flow AF without heating the emitter 103.

The higher the relative humidity of the air is, the more likely humans sense flavors expressed by flavor components contained in the air. The air flow AF formed by the non-heating type flavor component emission device 1 and containing a flavor component has a high relative humidity. Thanks to such a feature, the non-heating type flavor component emission device 1 allows the user to taste the flavor clearly.

The water retained in the water retainer 102 decreases when the water retainer 102 emits the water. Hence, when the water retained in the water retainer 102 decreases, the user again conducts such a work as immersing the water retainer 102 in the water. Thanks to such a work, the non-heating type flavor component emission device 1 can repeatedly emit the flavor component.

A gap between the hollow casing 101 and the water retainer 102 is desirably reduced. A gap between the hollow casing 101 and the emitter 103 is also desirably reduced. The reduced gaps can decrease the air flow AF passing through the gaps, and increase the air flow AF sequentially passing through the water retainer 102 and the emitter 103. Such a feature can increase the amount of the flavor component to be transmitted by the air flow AF.

1.2 Water Retainer

The water retainer 102 contains water.

The water retainer 102 contains at least one selected from the group consisting of a water-absorbing resin and a porous solid that retains water by capillarity.

The water-absorbing resin is a resin that swells and retains water. The water-absorbing resin is, for example, in a particulate state, a powdery state, or a fibrous state.

The porous solid that retains water by capillarity is, for example, a foam article, a fiber product, or a filter. The foam article is, for example, a sponge. The fiber product is, for example, a woven fabric or a nonwoven fabric.

1.4 Emission Material

Figure 3:
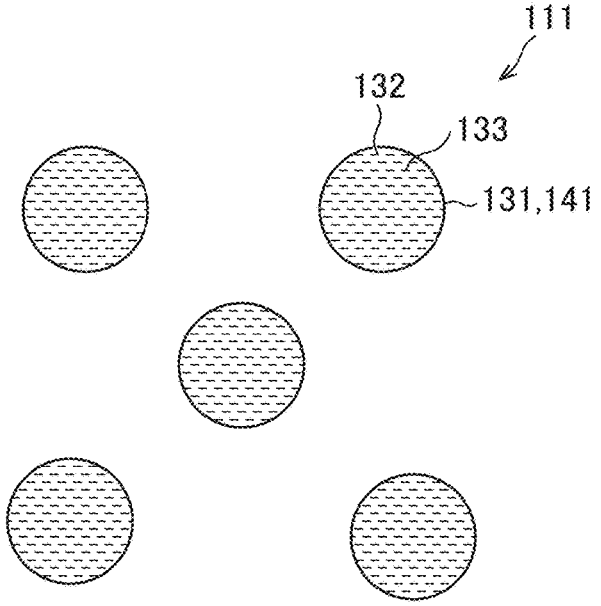
FIG. 3 is a cross-sectional view schematically illustrating an emission material included in the non-heating type flavor component emission device of the first embodiment.

FIG. 3 is a cross-sectional view schematically illustrating the emission material included in the non-heating type flavor component emission device of the first embodiment.

The emission material 111 illustrated in FIG. 3 absorbs moisture from the ambient air of the emission material 111 if the relative humidity of the ambient air of the emission material 111 is higher than an equilibrium humidity of the emission material 111. The emission material 111 emits the moisture into the ambient air of the emission material 111 if the relative humidity of the ambient air of the emission material 111 is lower than the equilibrium humidity of the emission material 111. The equilibrium humidity of the emission material 111 can be controlled with a material contained in the emission material 111.

As illustrated in FIG. 3, the emission material 111 includes: a water absorbent 131; a moisture control component 132; and a flavor component 133. The water absorbent 131 is made of a water absorbing material 141. The moisture control component 132 and the flavor component 133 are contained in the water absorbing material 141. The moisture control component 132 either absorbs or emits water. The moisture control component 132 contains a deliquescent component.

The water absorbent 131 and the water absorbing material 141 are in a particulate state. The water absorbent 131 and the water absorbing material 141 have a particle size of, for example, several millimeters to several tens of millimeters. The water absorbent 131 and the water absorbing material 141 are filled at a rate to such an extent that a clearance is formed between the particles to transmit the air flow AF.

The water absorbing material 141 can chemically or physically absorb the deliquescent component contained in the moisture control component 132. Such a feature can keep from separation of the deliquescent component from the water absorbing material 141, and reduce dehydration of the water absorbing material 141. If the moisture control component 132 is a moisture control liquid, the water absorbing material 141 can be impregnated with the moisture control liquid. Desirably, 100 parts by weight of the water absorbing material 141 is impregnated with 1 or more parts by weight and 1000 or less parts by weight of the moisture control liquid. Compared with a case where the moisture control liquid is used alone, the moisture control liquid impregnating the water absorbing material 141 can increase an interface between the moisture control component 132 and the air. Such a feature allows quick emission of the water and the flavor component 133.

The water absorbing material 141 contains at least one selected from the group consisting of a water absorbing resin and a clay mineral.

The water absorbing resin may be either an ionic resin or a non-ionic resin.

The ionic resin contains at least one selected from the group consisting of, for example, alkali metal salt of polyacrylic acid and starch-acrylate graft polymer. The alkali metal salt of polyacrylic acid contains, for example, sodium polyacrylate.

The non-ionic resin contains at least one selected from the group consisting of, for example, a vinyl acetate copolymer, a maleic anhydride copolymer, polyvinyl alcohol, and polyalkylene oxide.

The clay mineral contains at least one selected from the group consisting of, for example, silicate mineral and zeolite. The silicate mineral contains at least one selected from the group consisting of, for example, sepiolite, attapulgite, kaolinite perlite, and dolomite.

The deliquescent component contains salt that forms hydrate crystals within a relative humidity range of 30% RH or more and 80% RH or less. The salt desirably has a deliquescence point within a relative humidity range of 30% RH or more and 80% RH or less. Hence, if the moisture control component 132 has a threshold humidity within a relative humidity range of 30% RH or more and 80% RH or less. If the relative humidity of the ambient air is lower than the threshold humidity, the moisture control component 132 hardly absorbs moisture. If the relative humidity of the ambient air is higher than the threshold humidity, the moisture control component 132 can absorb moisture. The salt contains, for example, metal salt or carboxylic acid salt. The metal salt or the carboxylic acid salt contains at least one selected from the group consisting of sodium formate, sodium acetate, and sodium propionate.

The moisture control component 132 may contain a component other than the deliquescent component. For example, the moisture control component 132 may contain an additive for controlling the threshold humidity described above. The additive contains at least one selected from the group consisting of a salt other than the above salts, a polyhydric alcohol, and a nucleation material for hydrate crystals of the salts described above.

The other salt contains at least one of, for example, lithium chloride, calcium chloride, magnesium chloride, sodium benzoate, lithium bromide, calcium bromide, potassium bromide, sodium lactate, potassium lactate, potassium acetate, lithium acetate, potassium formate, sodium butyrate, sodium citrate, potassium citrate, sodium chloride, and potassium carbonate.

The polyhydric alcohol contains at least one selected from the group consisting of, for example, glycerin, propanediol, butanediol, pentanediol, trimethylolpropane, butanetriol, ethylene glycol, diethylene glycol, triethylene glycol, and lactic acid. The polyhydric alcohol desirably contains a polyhydric alcohol having three or more hydroxyl groups. The polyhydric alcohol having three or more hydroxyl groups contains, for example, glycerin. The polyhydric alcohol may constitute a dimer or a polymer.

The nucleation material contains at least one selected from the group consisting of, for example, carboxylic acids having two or more carboxyl groups and amides having two or more amide groups.

The flavor component 133 contains at least one selected from the group consisting of, for example, menthol, mint, chocolate, licorice, a fruit flavor, gamma octalactone, vanillin, ethyl vanillin, a spice flavor, methylsalicylate, linalool, bergamot oil, geranium oil, lemon oil, ginger oil, and a tobacco flavor.

1.5 Threshold Humidity of Carboxylic Acid Salt

Figure 4:
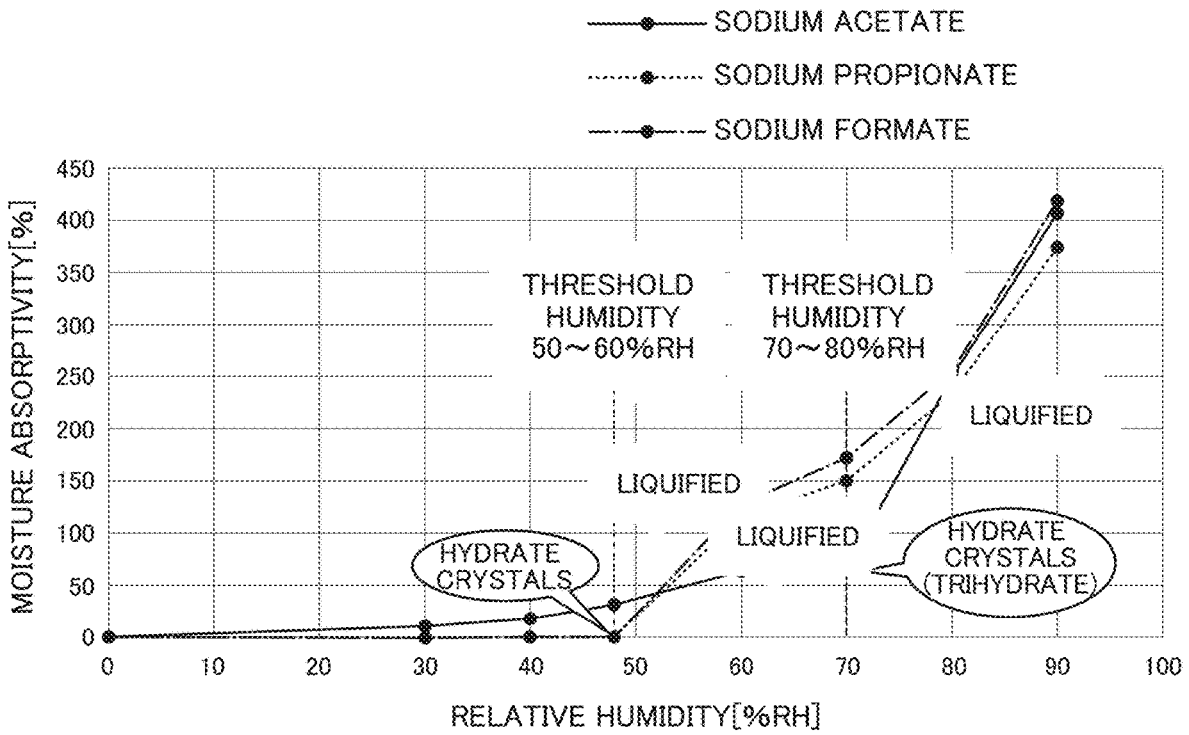
FIG. 4 is a graph showing moisture absorption isotherms of sodium acetate, sodium propionate, and sodium formate.

FIG. 4 is a graph showing moisture absorption isotherms of sodium acetate, sodium propionate, and sodium formate. In the graph shown in FIG. 4, the horizontal axis represents a relative humidity, and the vertical axis represents a moisture absorptivity.

Carboxylic acid salt; particularly, sodium salt of carboxylic acid, is hydrated to form rigid hydrate crystals with water molecules. The formed rigid hydrate crystals are further hydrated to deliquescence and become liquid. However, for the formed rigid hydrate crystals to further deliquescence, a large energy is required. Hence, when the relative humidity reaches a first relative humidity, carboxylic acid salt is hydrated to form rigid hydrate crystals with water molecules. When the relative humidity reaches a second relative humidity higher than the first relative humidity, the hydrate crystals deliquescence to become liquid. For example, as shown in FIG. 4, sodium acetate forms rigid hydrate crystals with water molecules at a relative humidity of approximately 70% RH or less. When the relative humidity reaches approximately 80% RH, the hydrate crystals deliquescence and become liquid. The hydrate crystals are a trihydrate. Furthermore, sodium propionate and sodium formate form rigid hydrate crystals with water molecules at a relative humidity of approximately 50% RH or less. The hydrate crystals deliquescence and become liquid when the relative humidity reaches approximately 60% RH.

Hence, carboxylic acid salt; particularly, sodium salt of carboxylic acid, has a relative humidity at which rigid hydrate crystals are formed with water molecules and/or a threshold humidity including a deliquescence point at which the hydrate crystals deliquescence and become liquid. If the relative humidity of the ambient air is lower than the threshold humidity, carboxylic acid salt does not proceed with moisture absorption more than the amount of moisture required to form the hydrate crystals with the water molecules. If the relative humidity of the ambient air rises above the threshold humidity, carboxylic acid salt rapidly proceeds with moisture absorption and the water absorption rate rises. For example, as shown in FIG. 4, if the relative humidity of the ambient air is lower than approximately 70 to 80% RH, sodium acetate does not proceed with moisture absorption more than the amount of moisture required to form the trihydrate. If the relative humidity of the ambient air is higher than approximately 70 to 80% RH, sodium acetate rapidly proceeds with moisture absorption and the moisture absorption rate rises. Furthermore, if the relative humidity of the ambient air is lower than approximately 50 to 60% RH, neither sodium propionate nor sodium formate proceeds with moisture absorption more than the amount of moisture required to form the hydrate crystals. If the relative humidity of the ambient air is higher than approximately 50 to 60% RH, sodium propionate and sodium formate rapidly proceed with moisture absorption and the moisture absorption rate rises.

Hence, carboxylic acid salt has a threshold humidity representing a boundary between a relative humidity at which moisture absorption hardly proceeds and a relative humidity at which moisture absorption rapidly proceeds. For example, as shown in FIG. 4, sodium acetate has a threshold humidity of approximately 70 to 80% RH. Furthermore, sodium propionate and sodium formate have a threshold humidity of approximately 50 to 60% RH.

Figure 5:
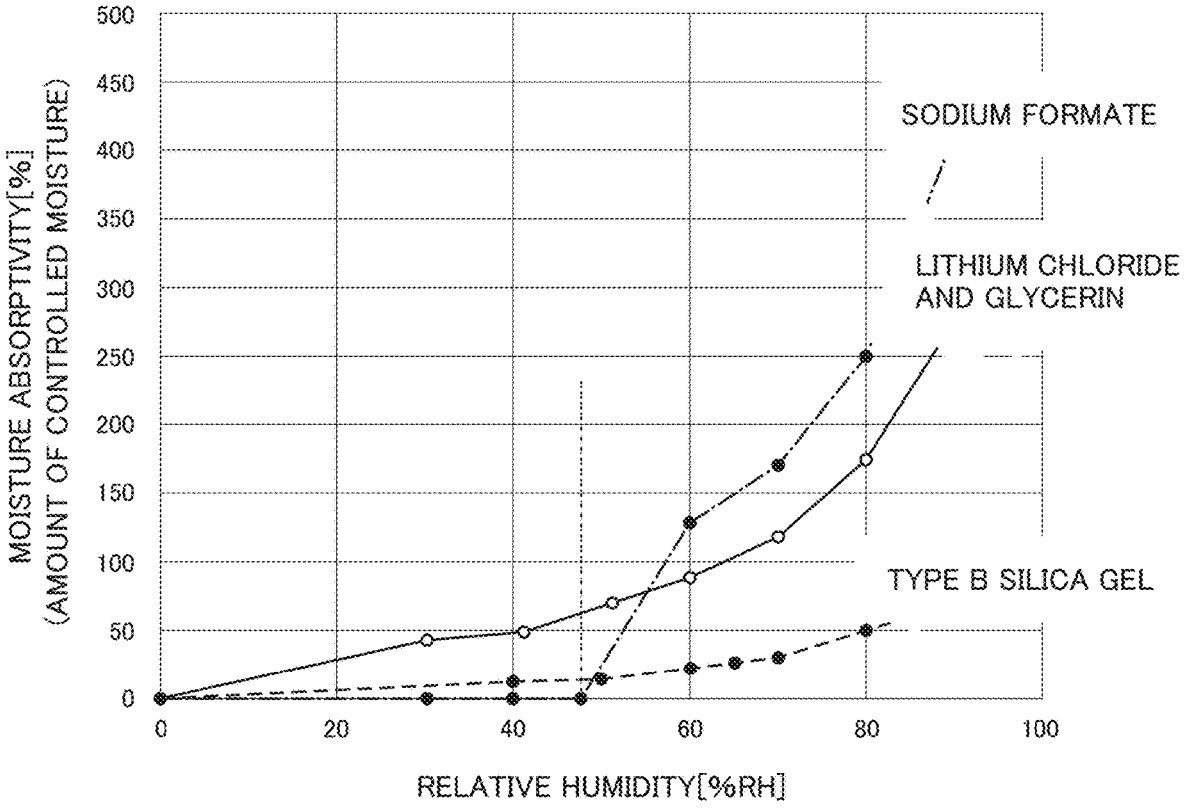
FIG. 5 is a graph showing moisture absorption isotherms of a moisture absorbing component containing type B silica gel, a moisture control component containing lithium chloride and glycerin, and a moisture control component containing sodium formate as a principal ingredient.

FIG. 5 is a graph showing moisture absorption isotherms of a moisture absorbing component containing type B silica gel, a moisture control component containing lithium chloride and glycerin, and a moisture control component containing sodium formate as a principal ingredient. In the graph shown in FIG. 5, the horizontal axis represents a relative humidity, and the vertical axis represents a moisture absorptivity.

The moisture absorption rates of the moisture absorbing component and the moisture control component having no threshold humidity gradually increase as the relative humidity increases. For example, as shown in FIG. 5, the moisture absorptivities of the moisture absorbing component containing the B-type silica gel, and of the humidity controlling component containing lithium chloride and glycerin, increase gradually as the relative humidity increases. Whereas, the moisture absorptivity of the moisture control component 132 having a threshold humidity is low within a range of the relative humidity lower than the threshold humidity, and rapidly increases as the relative humidity increases within a range of the relative humidity higher than the threshold humidity. For example, as shown in FIG. 5, the moisture absorptivity of the moisture control component 132 containing sodium formate as the principal ingredient is low within a relative humidity range of approximately 0 to 50% RH, and rapidly increases as the relative humidity increases within a relative humidity range of approximately 50 to 90% RH. Hence, the moisture control component 132 has a threshold humidity separating a relative humidity at which moisture absorption hardly proceeds from a relative humidity at which moisture absorption rapidly proceeds. For example, as shown in FIG. 5, a moisture control material containing sodium formate as the principal ingredient has a threshold humidity of approximately 50 to 60% RH to separate the relative humidity at which moisture absorption hardly proceeds from the relative humidity at which moisture absorption rapidly proceeds.

Two or more kinds of carboxylic acid salt may be combined together and included in the moisture control component 132. The additive described above may be included in the moisture control component 132 to exert influence on the formation of the hydrate crystals and to control the threshold humidity and humidity control characteristics.

1.6 Emission of Flavor Component

Figure 6:
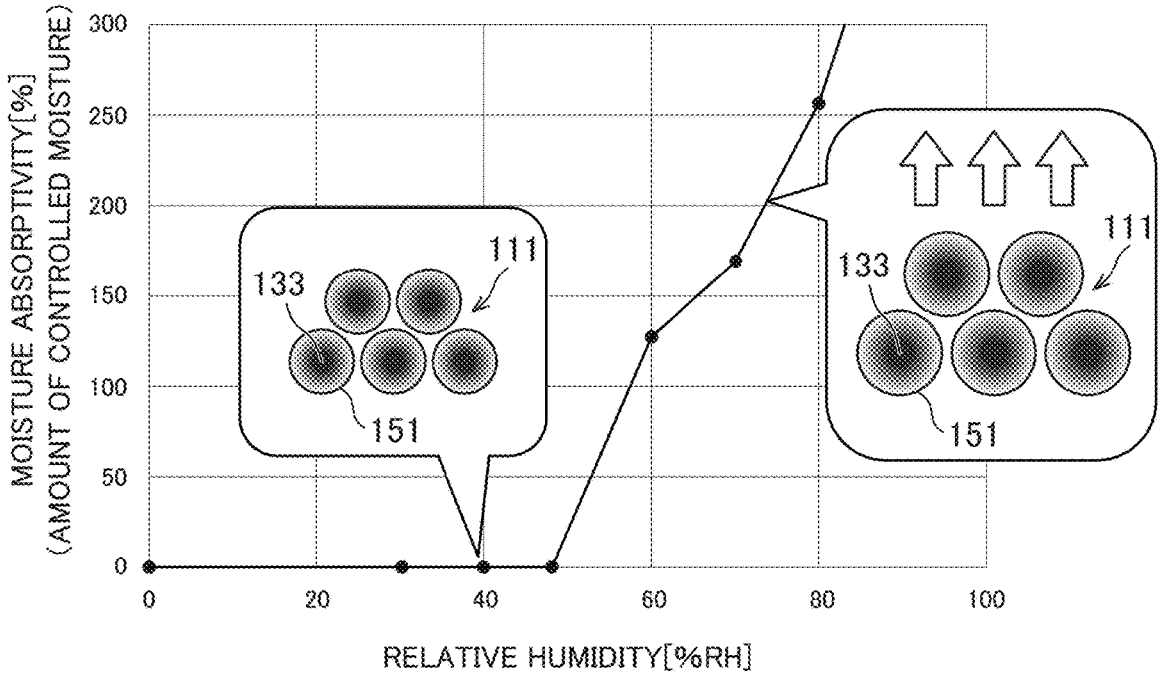
FIG. 6 is a graph schematically showing how a flavor component is emitted from the emission material included in the non-heating type flavor component emission device of the first embodiment.

FIG. 6 is a graph schematically showing how a flavor component is emitted from the emission material included in the non-heating type flavor component emission device of the first embodiment.

As shown in FIG. 6, if the relative humidity is lower than the threshold humidity, the deliquescent component 151 is crystallized, and the flavor component 133 is taken into the crystals of the deliquescent component 151. Such a feature reduces emission of the flavor component 133 from the emission material 111.

Whereas, if the relative humidity is higher than the threshold humidity, the deliquescent component 151 is not crystallized, and the crystal structure of the deliquescent component 151 is dissolved. Hence, the flavor component 133 is emitted from the deliquescent component 151. As a result, the flavor component 133 is sustained-released from the emission material 111.

These features described above can provide the emission material 111 with a function of an aromatic agent; that is, a change in relative humidity is utilized as a trigger to express a flavor.

If the relative humidity is lower than the threshold humidity and the deliquescent component 151 is crystallized, an outer shell of the water absorbing material 141 is cured, and the water absorbing material 141 becomes whitish capsules. Whereas, if the relative humidity is higher than the threshold humidity and the deliquescent component 151 is not crystallized, the water absorbing material 141 becomes transparent.

1.7 Method for Producing Emission Material

Figure 7A:
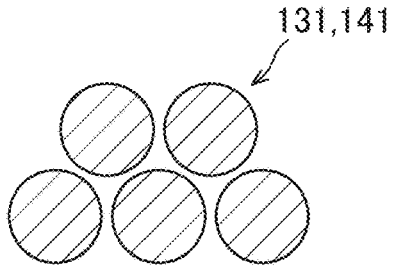
FIG. 7A is a diagram schematically illustrating a method for producing the emission material included in the non-heating type flavor component emission device of the first embodiment.
Figure 7B:
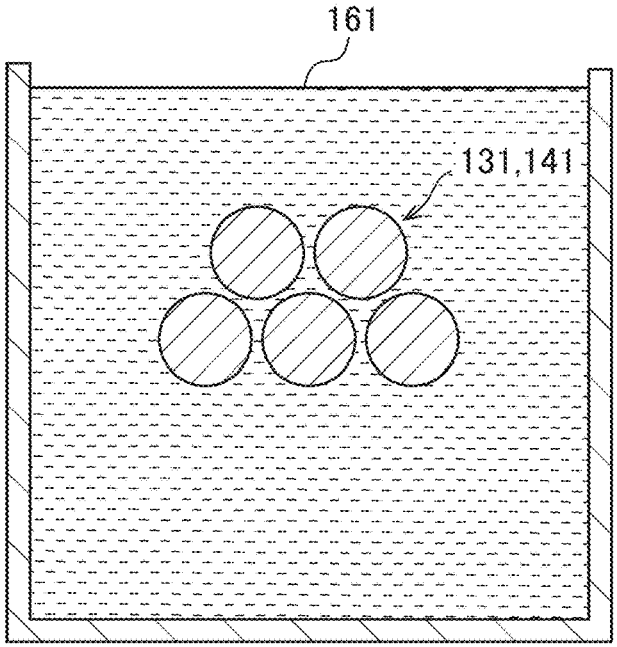
FIG. 7B is a diagram schematically illustrating the method for producing the emission material included in the non-heating type flavor component emission device of the first embodiment.
Figure 7C:
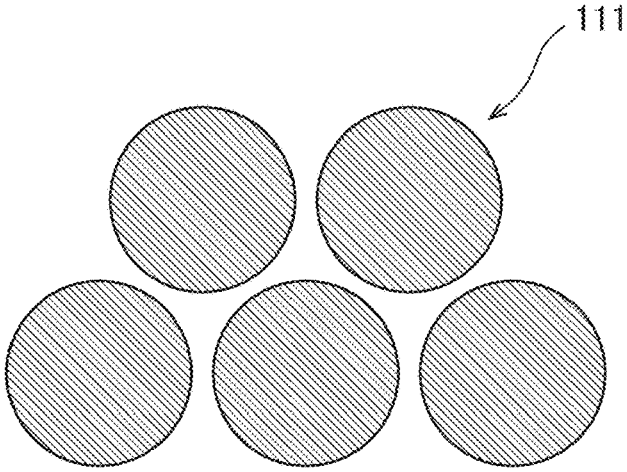
FIG. 7C is a diagram schematically illustrating the method for producing the emission material included in the non-heating type flavor component emission device of the first embodiment.

FIGS. 7A, 7B, and 7C are diagrams schematically illustrating a method for producing the emission material included in the non-heating type flavor component emission device of the first embodiment.

In producing the emission material 111, as illustrated in FIG. 7A, the water absorbent 131 is prepared.

Then, as illustrated in FIG. 7B, a moisture control liquid 161 is prepared. Furthermore, the prepared water absorbent 131 is immersed in the prepared moisture control liquid 161. The water absorbent 131 is continuously immersed in the moisture control liquid 161 for, for example, several hours to one day. Thus, the moisture control liquid 161 permeates into the water absorbent 131, and the emission material 111 is formed. The permeating moisture control liquid 161 serves as the moisture control component 132 and the flavor component 133 included in the emission material 111.

Then, as illustrated in FIG. 7C, the formed emission material 111 is taken out of the remaining moisture control liquid 161. The taken emission material 111 swells by, for example, 2 to 20 times.

1.8 Another Example of Water Absorbent

Figure 8:
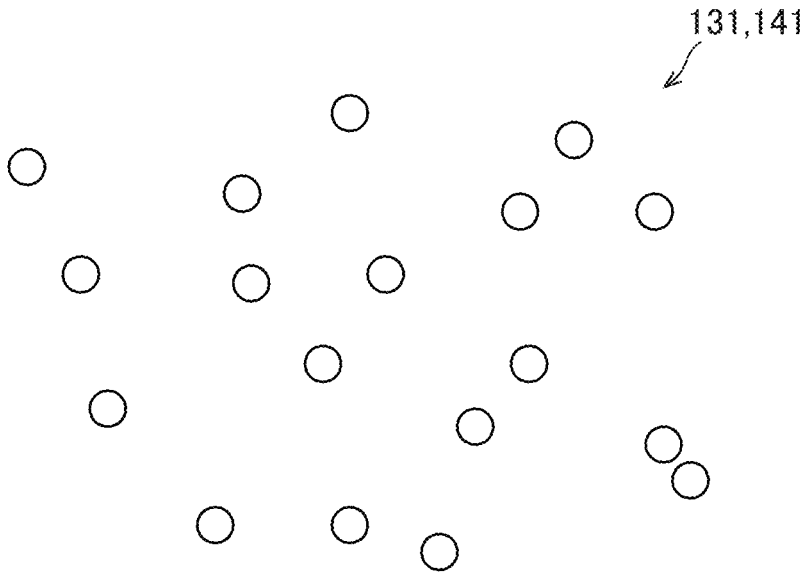
FIG. 8 is a cross-sectional view schematically illustrating a first other example of a water absorbent included in the non-heating type flavor component emission device of the first embodiment.

FIG. 8 is a plan view schematically illustrating a first other example of the water absorbent included in the non-heating type flavor component emission device of the first embodiment.

The water absorbent 131 is in a powdery state. The water absorbent 131 illustrated in FIG. 8 has a particle size of, for example, several micrometers to several millimeters. The water absorbent 131 and the water absorbing material 141 are filled at a rate to such an extent that a clearance is formed between the particulates of the powder to transmit the air flow AF.

Figure 9:
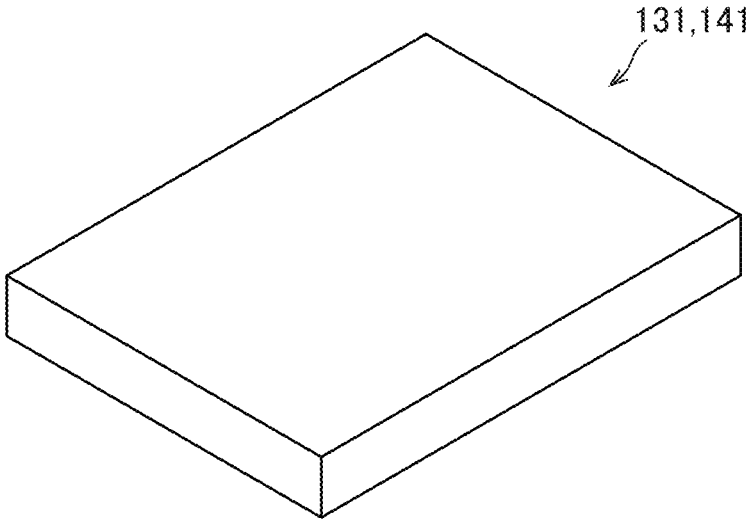
FIG. 9 is a cross-sectional view schematically illustrating a second other example of the water absorbent included in the non-heating type flavor component emission device of the first embodiment.

FIG. 9 is a perspective view schematically illustrating a second other example of the water absorbent included in the non-heating type flavor component emission device of the first embodiment.

The water absorbent 131 illustrated in FIG. 9 is shaped into a sheet. The water absorbent 131 and the water absorbing material 141 can transmit the air flow AF.

Figure 10:
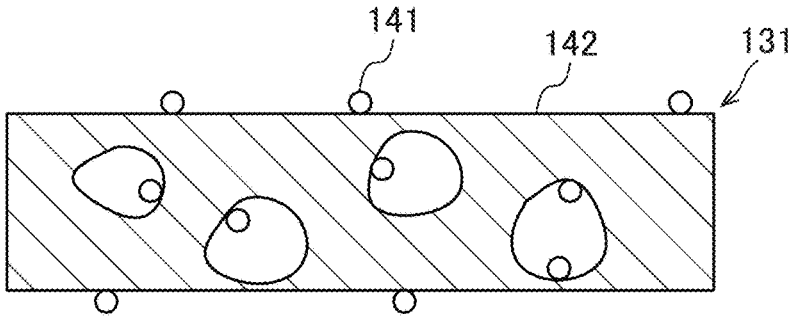
FIG. 10 is a cross-sectional view schematically illustrating a third other example of the water absorbent included in the non-heating type flavor component emission device of the first embodiment.

FIG. 10 is a cross-sectional view schematically illustrating a third other example of the water absorbent included in the non-heating type flavor component emission device of the first embodiment.

The water absorbent 131 illustrated in FIG. 10 includes: the water absorbing material 141; and a carrier 142. In the water absorbent 131 illustrated in FIG. 10, the water absorbing material 141 is either powdery or particulate. Furthermore, the carrier 142 is a porous solid. The porous solid is a foam article. Moreover, the water absorbing material 141 is carried by the carrier 142. When the porous solid constituting the carrier 142 is a foam article, the carrier 142 has high rigidity. Thus, the emission material 111 is stable in shape. The carrier 142 may be impregnated with the moisture control liquid. The water absorbent 131 and the carrier 142 can transmit the air flow AF.

Figure 11:
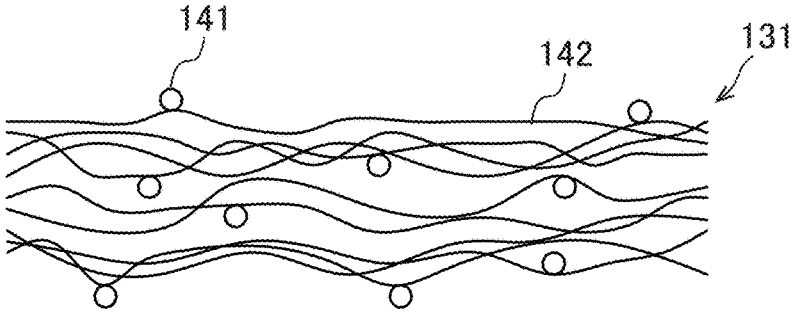
FIG. 11 is a cross-sectional view schematically illustrating a fourth other example of the water absorbent included in the non-heating type flavor component emission device of the first embodiment.

FIG. 11 is a cross-sectional view schematically illustrating a fourth other example of the water absorbent included in the non-heating type flavor component emission device of the first embodiment.

The water absorbent 131 illustrated in FIG. 11 includes: the water absorbing material 141; and the carrier 142. In the water absorbent 131 illustrated in FIG. 11, the water absorbing material 141 is either powdery or particulate. Furthermore, the carrier 142 is a porous solid. The porous solid is either a nonwoven fabric or a woven fabric. Moreover, the water absorbing material 141 is carried by the carrier 142. When the porous solid constituting the carrier 142 is either a nonwoven fabric or a woven fabric, the carrier 142 is flexible. Hence, the carrier 142 can alter in shape. The carrier 142 may be impregnated with the moisture control liquid. The water absorbent 131 and the carrier 142 can transmit the air flow AF. Hence, the water absorbing material 141 can be efficiently brought into contact with the air flow.

Figure 12:
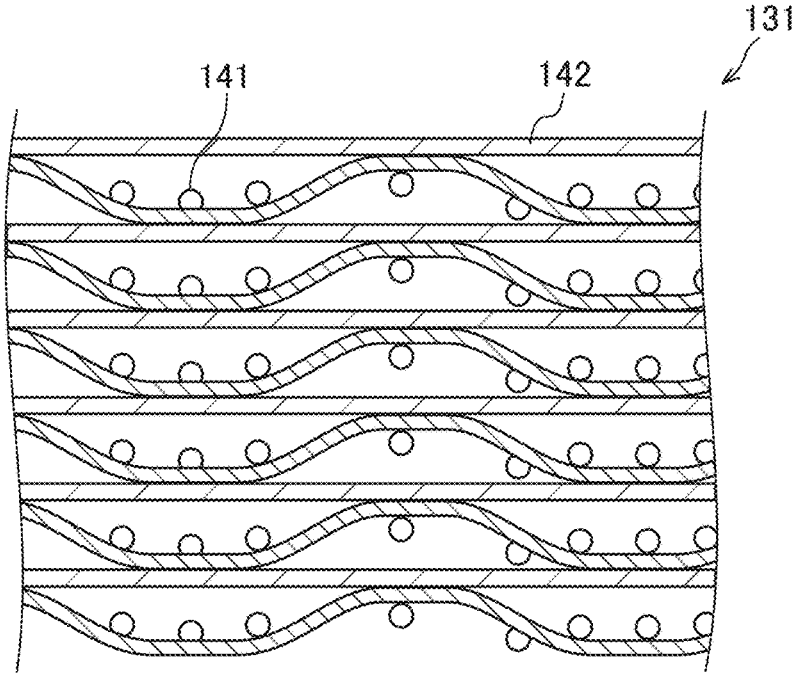
FIG. 12 is a cross-sectional view schematically illustrating a fifth other example of the water absorbent included in the non-heating type flavor component emission device of the first embodiment.

FIG. 12 is a cross-sectional view schematically illustrating a fifth other example of the water absorbent included in the non-heating type flavor component emission device of the first embodiment.

The water absorbent 131 illustrated in FIG. 12 includes: the water absorbing material 141; and the carrier 142. In the water absorbent 131 illustrated in FIG. 12, the water absorbing material 141 is either powdery or particulate. Furthermore, the carrier 142 is a ventilating member that allows the air flow to run in a direction perpendicular to the cross-section illustrated in FIG. 12. The ventilating member includes, for example, a corrugated nonwoven fabric. Moreover, the water absorbing material 141 is carried by the carrier 142. The water absorbent 131 illustrated in FIG. 12 allows the air flow to run in the ventilating member, so that the water absorbing material 141 carried by the ventilating member can be efficiently brought into contact with the air. Such a feature allows the water absorbing material 141 to efficiently emit the flavor component 133. The carrier 142 may be impregnated with the moisture control liquid. The water absorbent 131 and the carrier 142 can transmit the air flow AF. Hence, the water absorbing material 141 can be efficiently brought into contact with the air flow.

1.9 Modification

The above description shows a case where the water retainer 102 is, for example, a sponge, a nonwoven fabric, or a filter.

However, the water retainer 102 may be a water retainer that includes the water absorbent 131 and the moisture control component 132, and contains water.

2. Second Embodiment

Described below will be how a second embodiment is different from the first embodiment. Otherwise, the same configurations as those employed in the first embodiment are also employed in the second embodiment.

Figure 13:
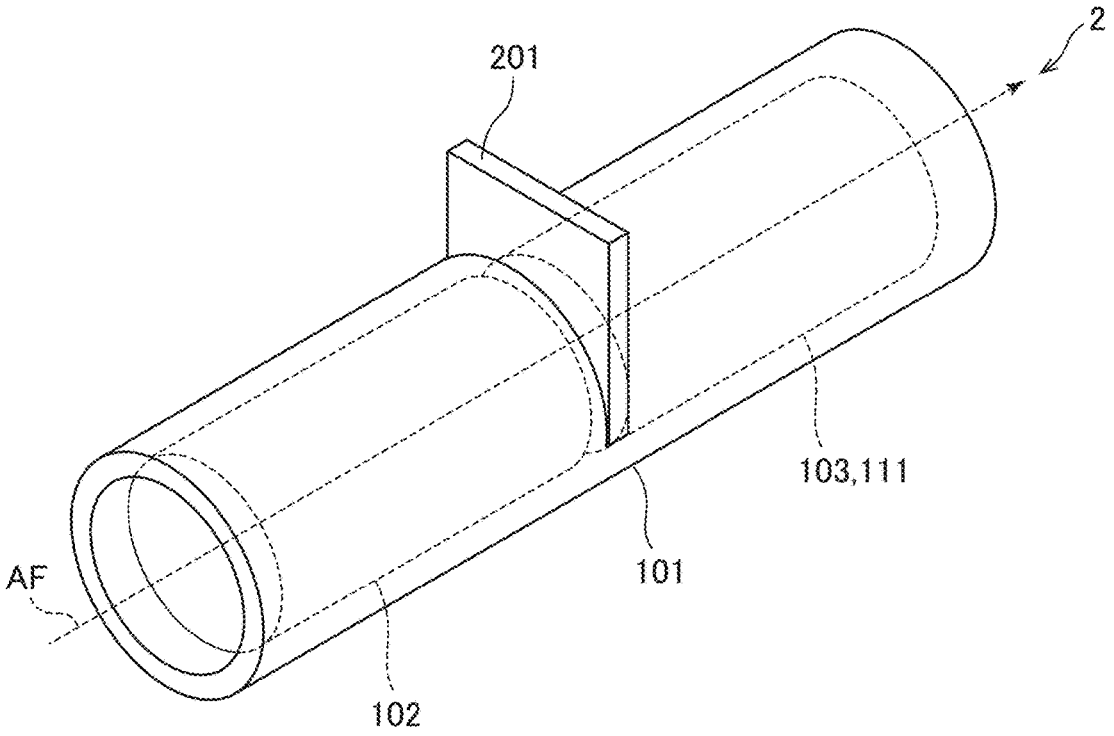
FIG. 13 is a perspective view schematically illustrating a non-heating type flavor component emission device of a second embodiment.
Figure 14:
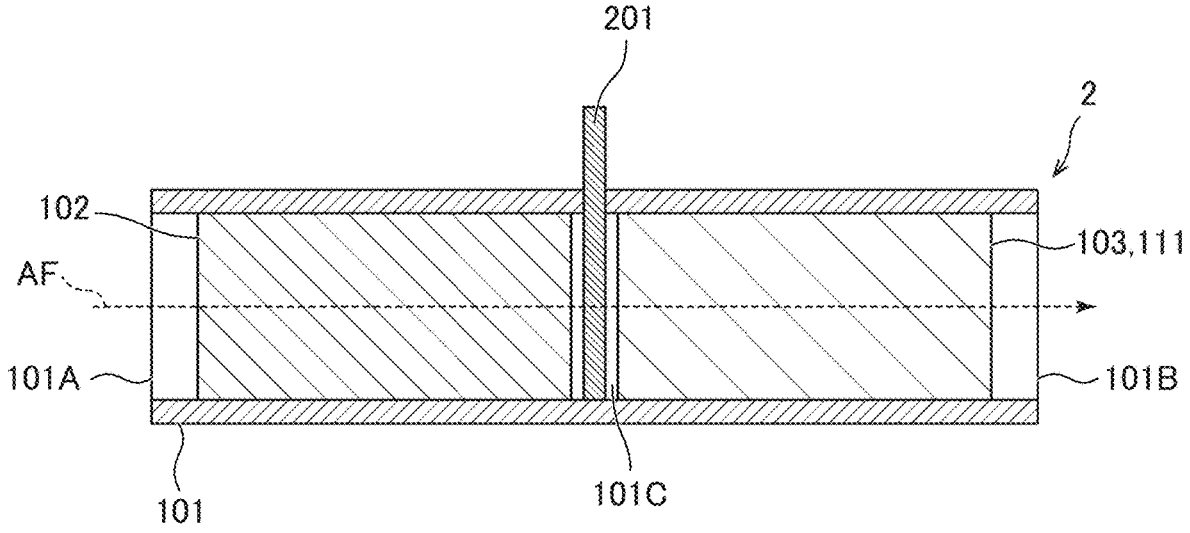
FIG. 14 is a cross-sectional view schematically illustrating the non-heating type flavor component emission device of the second embodiment.

FIG. 13 is a perspective view schematically illustrating a non-heating type flavor component emission device of a second embodiment. FIG. 14 is a cross-sectional view schematically illustrating the non-heating type flavor component emission device of the second embodiment.

As illustrated in FIGS. 13 and 14, a non-heating type flavor component emission device 2 of the second embodiment includes a separating plate 201.

The separating plate 201 is attached to, and detached from, an interior of the flow path 101C. The separating plate 201 is attached and detached out of the hollow casing 101. The separating plate 201 is: attached to the interior of the flow path 101C when the non-heating type flavor component emission device 2 is not in use; and removed from the interior of the flow path 101C when the non-heating type flavor component emission device 2 is in use. When attached to the interior of the flow path 101C, the separating plate 201 separates the water retainer 102 from the emitter 103. When removed from the interior of the flow path 101C, the separating plate 201 does not separate the water retainer 102 from the emitter 103. Such a feature can keep the air flow AF, which has a high relative humidity when the non-heating type flavor component emission device 2 is not in use, from passing through the emitter 103 containing the crystalized deliquescent component 151.

Furthermore, in the non-heating type flavor component emission device 2 of the second embodiment, the water retainer 102 is a water retainer that includes the water absorbent 131 and the moisture control component 132, and contains water.

The water retainer 102 may be an emission material that includes the water absorbent 131, the moisture control component 132, and the flavor component 133, and emits the flavor component 133 into the air flow AF. In this case, the emission material 111 is a first emission material, the water retainer 102 is a second emission material, the flavor component 133 emitted by the emission material 111 is a first flavor component, and a flavor component emitted by the water retainer 102 is a second flavor component.

In this case, in the initial state, the water retainer 102 has a relative humidity higher than the threshold humidity of the water retainer 102. Hence, the water retainer 102 contains the deliquescent component 151 not crystallized. Furthermore, the water retainer 102 has a high relative humidity of, desirably, 70% RH or more, and more desirably, 80% RH or more and 100% RH or less. Such a feature can keep the relative humidity of the water retainer 102 from falling below the relative humidity of the ambient air of the water retainer 102, and keep the water retainer 102 from inevitably absorbing moisture instead of emitting the moisture. As a result, the user is free from a work to supply the water retainer 102 with water.

The water retainer 102 transmits the air flow AF, and emits water and the second flavor component into the air flow AF to be transmitted, in order to form the air flow AF having a high relative humidity and containing the second flavor component.

The emitter 103 transmits the formed air flow AF, absorbs the moisture contained in the air flow AF to be transmitted, and emits water and the first flavor component into the air flow AF to be transmitted after the relative humidity rises above the threshold humidity in order to form the air flow AF having a high relative humidity and containing the first flavor component and the second flavor component.

Figure 15:
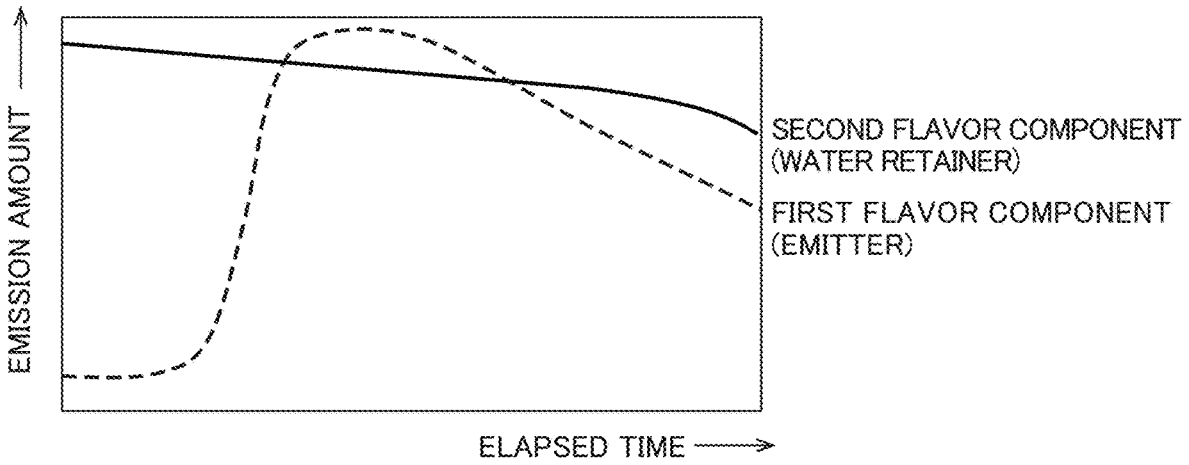
FIG. 15 is a graph showing an example of changes in the amounts of a first flavor component and a second flavor component emitted from the non-heating type flavor component emission device of the second embodiment. The changes are observed as time elapses since an air flow starts to form.

FIG. 15 is a graph showing an example of changes in the amounts of the first flavor component and the second flavor component emitted from the non-heating type flavor component emission device of the second embodiment. The changes are observed as time elapses since the air flow starts to form. In the graph shown in FIG. 15, the horizontal axis represents an elapsed time, and the vertical axis represents an emission amount.

As shown in FIG. 15, the amount of the second flavor component emitted by the water retainer 102 is large immediately after the air flow AF starts to form. Whereas, the amount of the first flavor component generated by the emitter 103 is small immediately after the air flow AF starts to form. The amount increases when the relative humidity of the ambient air of the emitter 103 rises above the threshold humidity. As a result, the non-heating type flavor component emission device 2 emits the second flavor component immediately after the air flow AF starts to form, and emits the first flavor component after a certain elapsed time since the air flow AF starts to form. Such a feature allows the user to enjoy: the change of flavors expressed by the first flavor component and the second flavor component as time elapses; and a blend of flavors expressed by the first flavor component and the second flavor component.

3. Third Embodiment

Described below will be how a third embodiment is different from the second embodiment. Otherwise, the same configurations as those employed in the second embodiment are also employed in the third embodiment.

Figure 16:
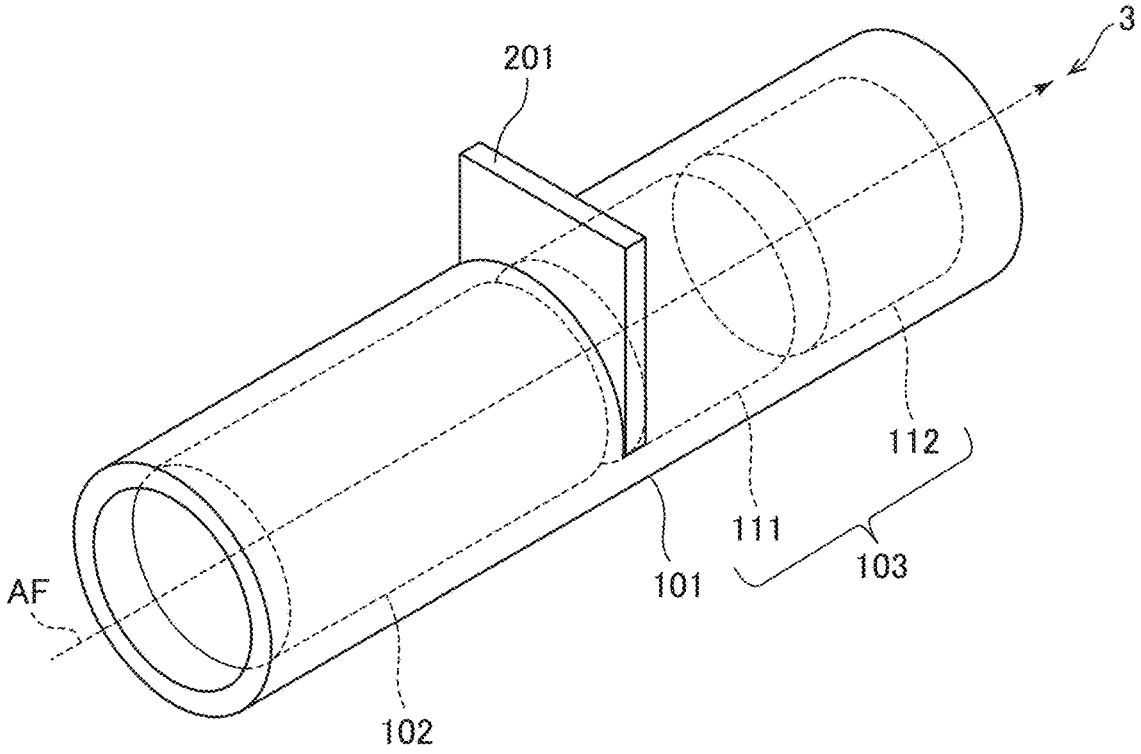
FIG. 16 is a perspective view schematically illustrating a non-heating type flavor component emission device of a third embodiment.
Figure 17:
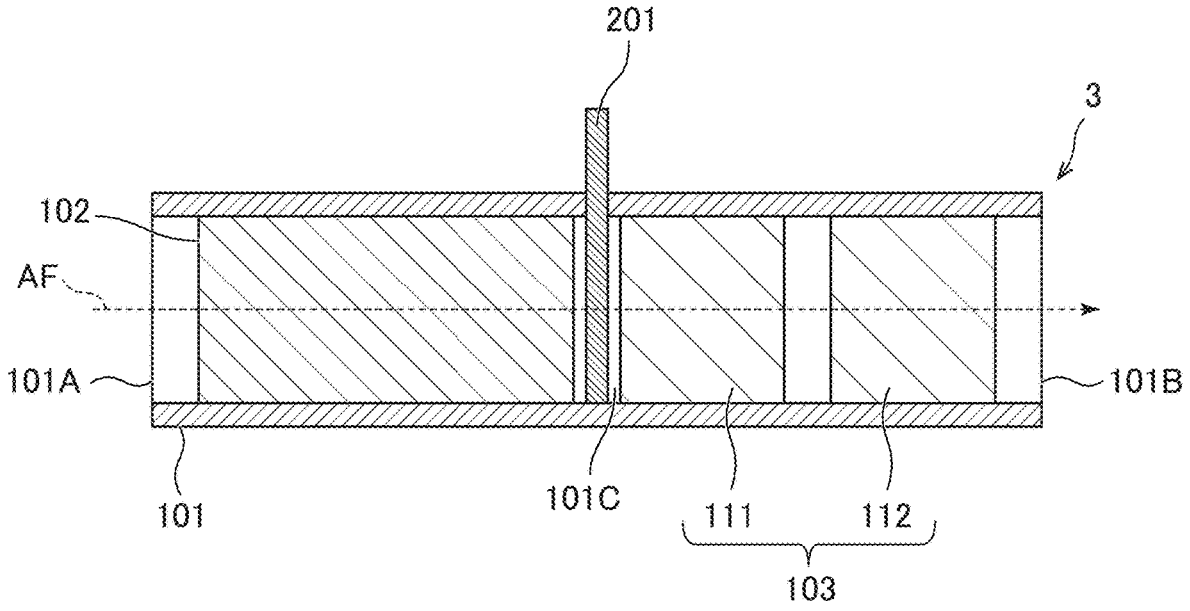
FIG. 17 is a cross-sectional view schematically illustrating the non-heating type flavor component emission device of the third embodiment.

FIG. 16 is a perspective view schematically illustrating a non-heating type flavor component emission device of a third embodiment. FIG. 17 is a cross-sectional view schematically illustrating the non-heating type flavor component emission device of the third embodiment.

As illustrated in FIGS. 16 and 17, in a non-heating type flavor component emission device 3 of the third embodiment, the emitter 103 includes a plurality of emission materials 111 and 112.

The plurality of emission materials 111 and 112 include two emission materials. The plurality of emission materials 111 and 112 may include three or more emission materials.

The plurality of emission materials 111 and 112 are arranged in a direction in which the flow path 101C extends. Hence, the plurality of emission materials 111 and 112 are arranged in a direction in which the air flow AF flows.

The emission materials 111 and 112 each emit a corresponding one of a plurality of flavor components into the air flow AF.

Each of the plurality of emission materials 111 and 112 has a threshold humidity. If a relative humidity is higher than the threshold humidity, each of the emission materials 111 and 112 emits the corresponding one of the flavor components. If the relative humidity is lower than the threshold humidity, each of the emission materials 111 and 112 is kept from emitting the corresponding one of the flavor components.

The plurality of emission materials 111 and 112 have different threshold humidities. Desirably, as an emission material contained in the plurality of emission materials 111 and 112 is positioned more downstream of the air flow AF, a threshold humidity of the emission material increases.

Each of the plurality of emission materials 111 and 112 in the initial state has a relative humidity lower than the threshold humidity of each of the emission materials.

The water retainer 102 transmits the air flow AF, emits water into the air flow AF to be transmitted, and forms the air flow AF having a high relative humidity.

The emission material 111 transmits the formed air flow AF, absorbs the moisture contained in the air flow AF to be transmitted, and emits the moisture and the first flavor component into the air flow AF to be transmitted after the relative humidity rises above the threshold humidity in order to form the air flow AF having a high relative humidity and containing the first flavor component.

The emission material 112 transmits the formed air flow AF, absorbs the moisture contained in the air flow AF to be transmitted, and emits the moisture and the second flavor component into the air flow AF to be transmitted after the relative humidity rises above the threshold humidity in order to form the air flow AF having a high relative humidity and containing the first flavor component and the second flavor component.

The absorption of the moisture emitted by the water retainer 102 progresses from upstream toward downstream of the air flow AF. Hence, the emission of the flavor components progresses from upstream toward downstream of the air flow AF. Such a feature makes it possible to efficiently transport the flavor components with the air flow AF.

Figure 18:
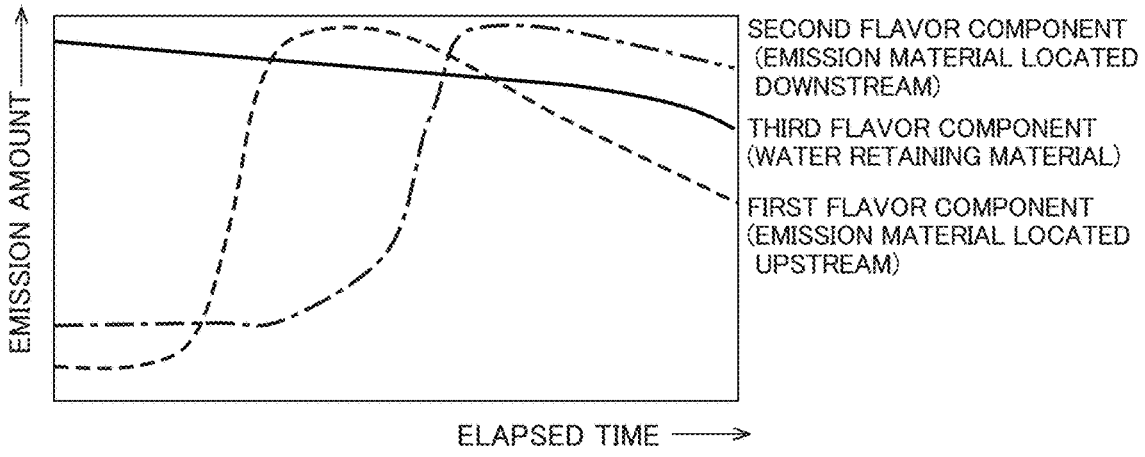
FIG. 18 is a graph showing an example of changes in the amounts of a first flavor component, a second flavor component, and a third flavor component emitted from the non-heating type flavor component emission device of the third embodiment. The changes are observed as time elapses since an air flow starts to form.

FIG. 18 is a graph showing an example of changes in the amounts of the first flavor component, the second flavor component, and a third flavor component emitted from the non-heating type flavor component emission device of the third embodiment. The changes are observed as time elapses since the air flow starts to form. In the graph shown in FIG. 18, the horizontal axis represents an elapsed time, and the vertical axis represents an emission amount.

The third flavor component is the flavor component 133 emitted by the water retainer 102 if the water retainer 102 includes: the water absorbent 131; the moisture control component 132; and the flavor component 133, and serves as an emission material that emits the flavor component 133 into the air flow AF.

As shown in FIG. 18, the amount of the third flavor component emitted by the water retainer 102 is large immediately after the air flow AF starts to form. Whereas, the amount of the first flavor component emitted by the emission material 111 located upstream is small immediately after the air flow AF starts to form. The amount increases when the relative humidity of the ambient air of the emission material 111 rises above the threshold humidity. Furthermore, the amount of the second flavor component emitted by the emission material 112 located downstream is small immediately after the air flow AF starts to form. The amount increases when the relative humidity of the ambient air of the emission material 112 rises above the threshold humidity. That is, the non-heating type flavor component emission device 3 emits the third flavor component immediately after the air flow AF starts to form, emits the first flavor component and the second flavor component after a certain elapsed time since the air flow AF starts to form. After emitting the second flavor component, the non-heating type flavor component emission device 3 emits the third emission component. Such a feature allows the user to enjoy: the change of flavors expressed by the first flavor component, the second flavor component, and the third flavor component as time elapses; and a blend of flavors expressed by the first flavor component, the second flavor component, and the third flavor component. When a human is exposed to the same flavor for a long time, the human sense of smell adapts to the flavor and becomes less sensitive to the flavor. Hence, the human is sequentially exposed to flavors expressed by the third flavor component, the first flavor component, and the second flavor component, so that the human sense of smell can determine the flavors for a long time.

Figure 19:
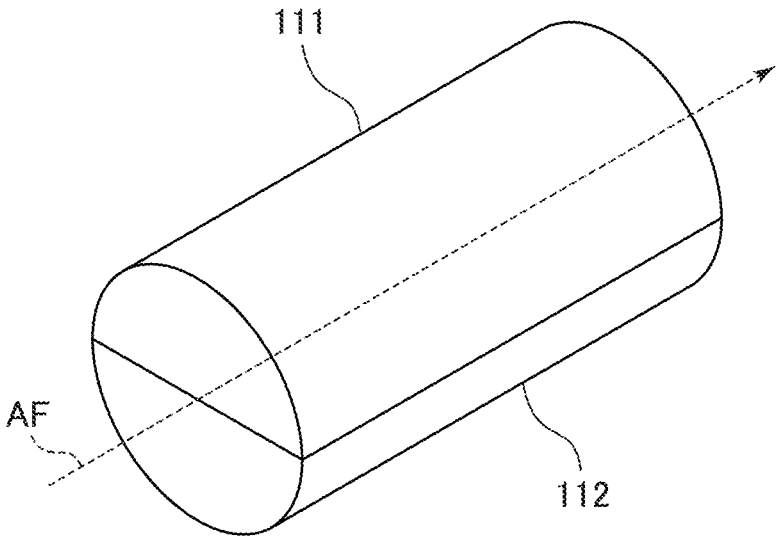
FIG. 19 is a cross-sectional view schematically illustrating a first other example of a plurality of emission materials included in the non-heating type flavor component emission device of the third embodiment.

FIG. 19 is a cross-sectional view schematically illustrating a first other example of the plurality of emission materials included in the non-heating type flavor component emission device of the third embodiment.

The plurality of emission materials 111 and 112 illustrated in FIG. 19 are linearly arranged in a direction perpendicular to the direction in which the flow path 101C extends. Hence, the plurality of emission materials 111 and 112 are linearly arranged in a direction perpendicular to the direction in which the air flow AF flows. In this case, the threshold humidities of the plurality of emission materials 111 and 112 may be the same. Even if the threshold humidities of the plurality of emission materials 111 and 112 are different, either threshold humidity of the emission material 111 or of the emission material 112 may be high. The water absorbent 131 and the water absorbing material 141 of the plurality of emission materials 111 and 112 may be the same or different among the forms illustrated in FIGS. 3 and 8 to 12. The larger the surface areas are of the water absorbent 131 and the water absorbing material 141, the higher the contact efficiency is of the water absorbent 131 and the water absorbing material 141 with the air flow. Such a feature allows efficient emission of the flavor component 113. When the water absorbent 131 and the water absorbing material 141 are selected, the release of the flavor component 133 can be temporally sustained.

Figure 20:
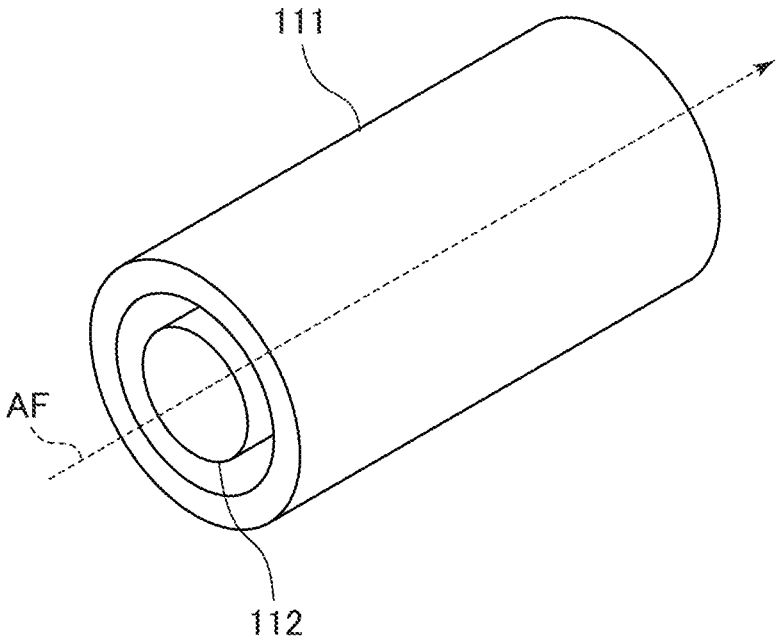
FIG. 20 is a cross-sectional view schematically illustrating a second other example of the plurality of emission materials included in the non-heating type flavor component emission device of the third embodiment.

FIG. 20 is a cross-sectional view schematically illustrating a second other example of the plurality of emission materials included in the non-heating type flavor component emission device of the third embodiment.

The plurality of emission materials 111 and 112 illustrated in FIG. 20 are concentrically arranged in a direction perpendicular to the direction in which the flow path 101C extends. Hence, the plurality of emission materials 111 and 112 are concentrically arranged in a direction perpendicular to the direction in which the air flow AF flows. In this case, the threshold humidities of the plurality of emission materials 111 and 112 may be the same. Even if the threshold humidities of the plurality of emission materials 111 and 112 are different, either threshold humidity of the emission material 111 or of the emission material 112 may be high. The water absorbent 131 and the water absorbing material 141 of the plurality of emission materials 111 and 112 may be the same or different among the forms illustrated in FIGS.

3 and 8 to 12. The larger the surface areas are of the water absorbent 131 and the water absorbing material 141, the higher the contact efficiency is of the water absorbent 131 and the water absorbing material 141 with the air flow. Such a feature allows efficient emission of the flavor component 113. When the water absorbent 131 and the water absorbing material 141 are selected, the release of the flavor component 133 can be temporally sustained.

When the plurality of emission materials 111 and 112 are arranged in a direction perpendicular to the direction in which the air flow AF flows, a flavor component emitted by one of the plurality of emission materials 111 and 112 does not pass through another one of the plurality of emission materials 111 and 112. Such a feature can reduce the risk that a flavor component emitted from the one of the plurality of emission materials 111 and 112 is adsorbed by the other one of the plurality of emission materials 111 and 112, and that the flavor becomes weak when expressed by the flavor component emitted from the one of the plurality of emission materials 111 and 112. Furthermore, the flavor components emitted by the plurality of emission materials 111 and 112 can be efficiently transported by the air flow AF.

4. Fourth Embodiment

Described below will be how a fourth embodiment is different from the first embodiment. Otherwise, the same configurations as those employed in the first embodiment are also employed in the fourth embodiment.

Figure 21:
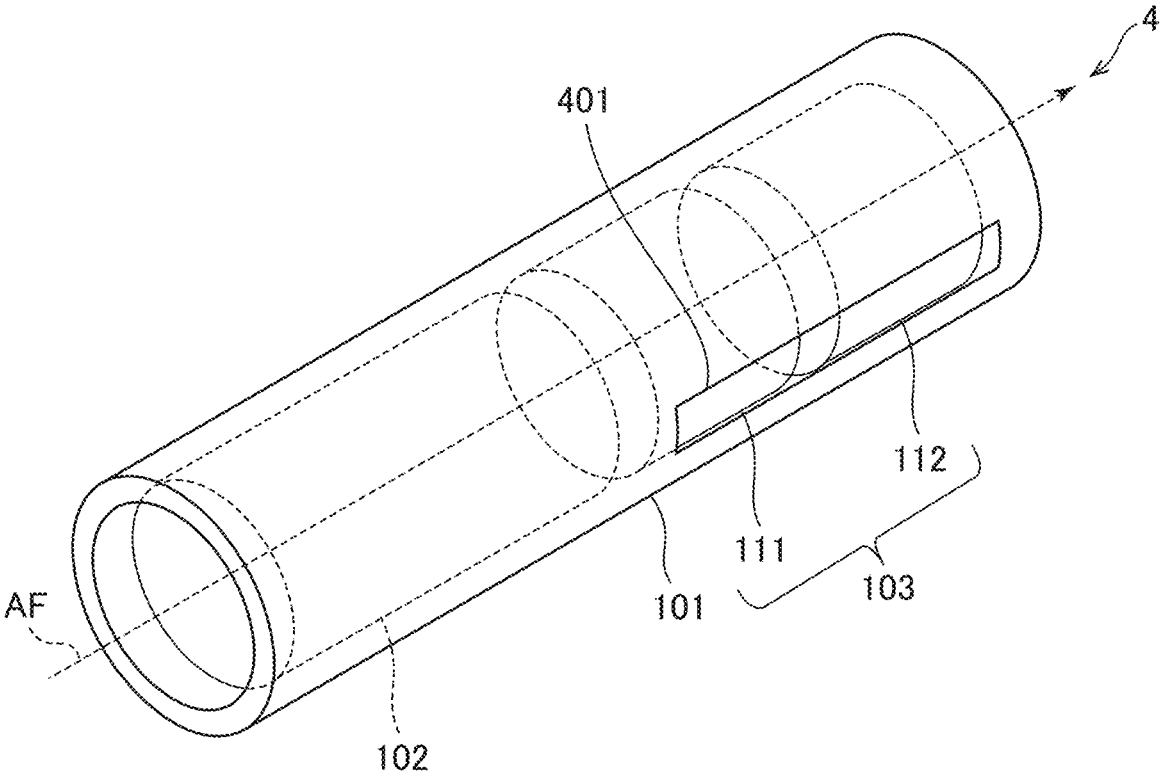
FIG. 21 is a perspective view schematically illustrating a non-heating type flavor component emission device of a fourth embodiment.

FIG. 21 is a perspective view schematically illustrating a non-heating type flavor component emission device of a fourth embodiment.

As illustrated in FIG. 21, in a non-heating type flavor component emission device 4 of the fourth embodiment, the emitter 103 includes the plurality of emission materials 111 and 112 as seen in the non-heating type flavor component emission device 3 of the third embodiment.

Furthermore, in the non-heating type flavor component emission device 4 of the fourth embodiment, the hollow casing 101 includes a transparent window 401.

The transparent window 401 transmits not the air flow AF but light.

The emitter 103 is disposed along the transparent window 401. Hence, the emitter 103 is visible out of the hollow casing 101 through the transparent window 401. Such a feature allows the user to observe an appearance of the emitter 103. If the appearance of the emitter 103 indicates whether the flavor component 133 can be emitted, the non-heating type flavor component emission device 4 can indicate whether the flavor component 133 can be emitted.

As described above, if the relative humidity is lower than the threshold humidity and the deliquescent component 151 is crystallized, an outer shell of the water absorbing material 141 is cured, and the water absorbing material 141 becomes whitish capsules. Whereas, if the relative humidity is higher than the threshold humidity and the deliquescent component 151 is not crystallized, the water absorbing material 141 becomes transparent. Such a change in the appearance of the water absorbing material 141 appears as a change in the appearance of the emission material 111. Then, the change in the appearance of the emission material 111 can be visually recognized out of the non-heating type flavor component emission device 4 through the transparent window 401. Thanks to such features, the emission material 111 can indicate whether the emission material 111 can emit the flavor component 133. Hence, the emission material 111 can indicate that the sustained-release of the flavor component has ended.

The emission materials 111 and 112 may contain a dye. Thanks to the dye, the user can recognize more clearly whether the deliquescent component 151 is crystallized. The dye is desirably an edible dye. Thanks to such a feature, even if the dye is emitted together with a flavor component, the emitted dye is edible and highly safe. Hence, the non-heating type flavor component emission device 4 successfully assures the user of great safety. The edible dye includes at least one selected from the group consisting of, for example, an annatto dye, a turmeric dye, a caramel dye, a gardenia blue dye, a gardenia red dye, a gardenia yellow dye, a cochineal dye, a monascus color dye, a safflower red dye, a safflower yellow dye, an anthocyanin dye, a paprika dye, and a flavonoid dye.

5. Fifth Embodiment

Figure 22:
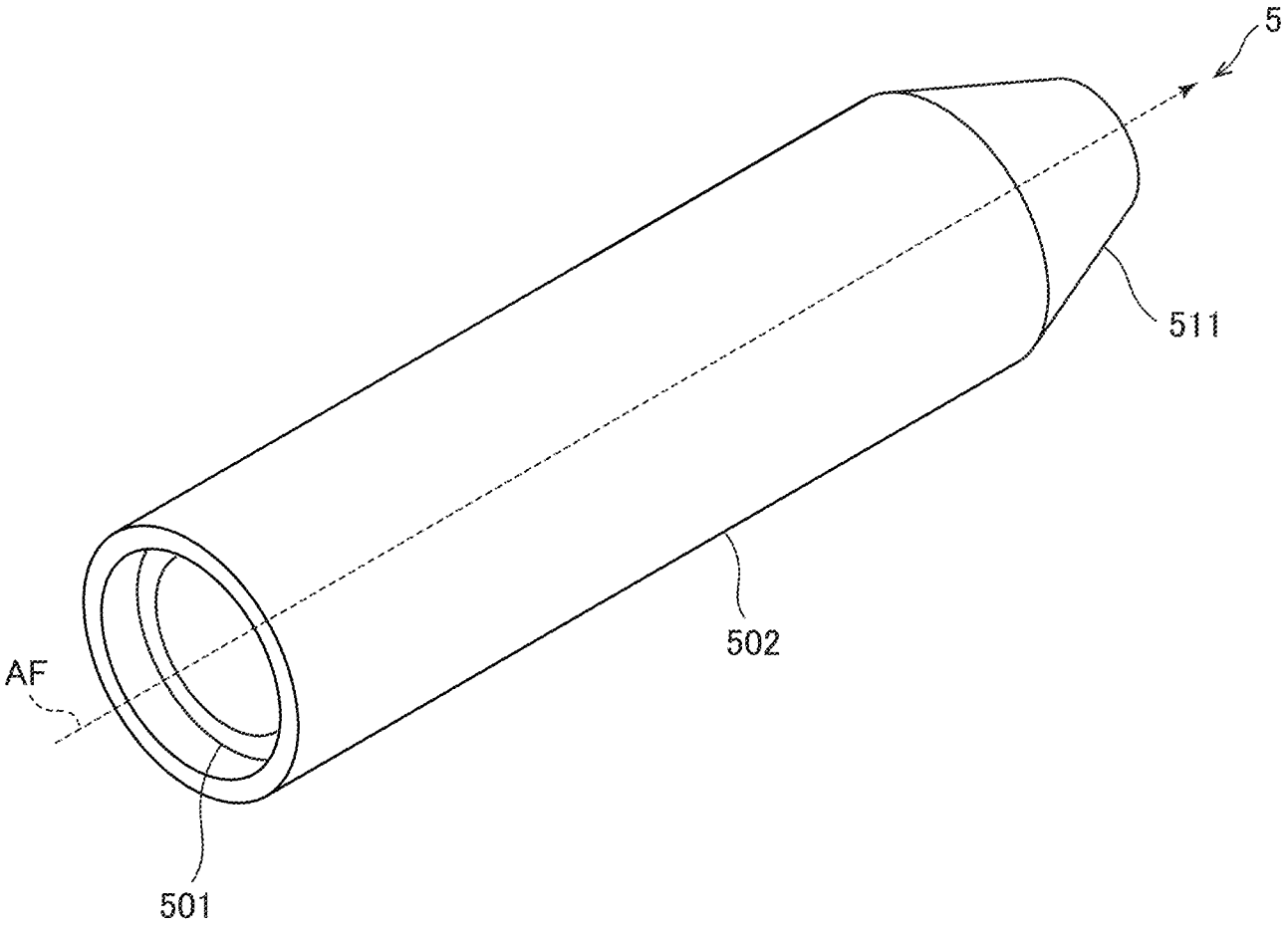
FIG. 22 is a perspective view schematically illustrating a non-heating type flavor inhaler of a fifth embodiment.
Figure 23:
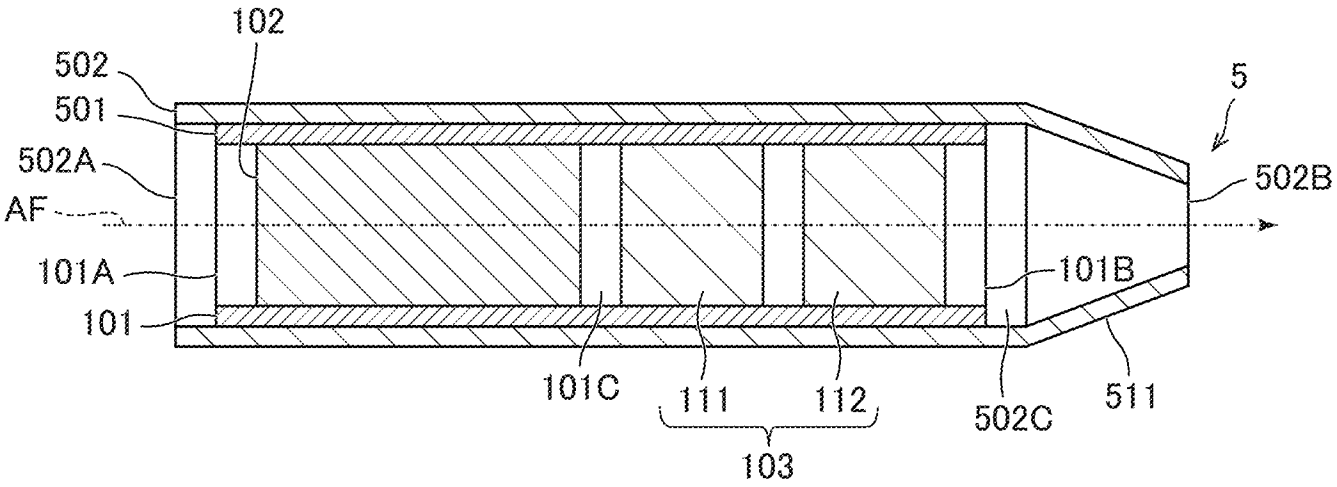
FIG. 23 is a cross-sectional view schematically illustrating the non-heating type flavor inhaler of the fifth embodiment.

FIG. 22 is a perspective view schematically illustrating a non-heating type flavor inhaler of a fifth embodiment. FIG. 23 is a cross-sectional view schematically illustrating the non-heating type flavor inhaler of the fifth embodiment.

As illustrated in FIGS. 22 and 23, a non-heating type flavor inhaler 5 of the fifth embodiment includes: a non-heating type flavor component emission device 501; and a cylindrical holder 502.

The non-heating type flavor component emission device 501 is the non-heating type flavor component emission device 1 of the first embodiment, the non-heating type flavor component emission device 2 of the second embodiment, the non-heating type flavor component emission device 3 of the third embodiment, or the non-heating type flavor component emission device 4 of the fourth embodiment. Alternatively, the non-heating type flavor component emission device 501 is a modification of one of the non-heating type flavor component emission devices 1 to 4. The non-heating type flavor component emission device 501 is a replaceable cartridge attached to, and detached from, the cylindrical holder 502.

The cylindrical holder 502 is shaped into a cylinder. Hence, the cylindrical holder 502 is provided with an inlet 502A, an outlet 502B, and a housing space 502C.

The housing space 502C extends from the inlet 502A to the outlet 502B. Hence, the air flow AF enters the housing space 502C through the inlet 502A. Then, the air flow AF is guided by the housing space 502C from the inlet 502A to the outlet 502B, and exits the housing space 502C through the outlet 502B.

The housing space 502C houses the non-heating type flavor component emission device 501.

The cylindrical holder 502 includes a mouthpiece portion 511. The mouthpiece portion 511 is provided to an end of the cylindrical holder 502. The mouthpiece portion 511 is provided with the outlet 502B.

A user of the non-heating type flavor inhaler 5 sucks the mouthpiece portion 511, and forms the air flow AF. Such a feature allows the user to inhale the air flow AF containing a flavor component. Unlike a combustible tobacco product or a heating type tobacco product, the non-heating type flavor inhaler 5 allows the user to have a pleasure similar to smoking without heating. Furthermore, even if the flavor component does not include a flavor component of tobacco, the user enjoys mock smoking to taste a flavor component that is not the flavor component of tobacco. Such a feature can provide the user with physical and mental relaxation, better health, and cosmetic improvement. Moreover, the non-heating type flavor component emission device 501 is replaced with another one, and the user can enjoy various flavor components.

6. Sixth Embodiment

Figure 24:
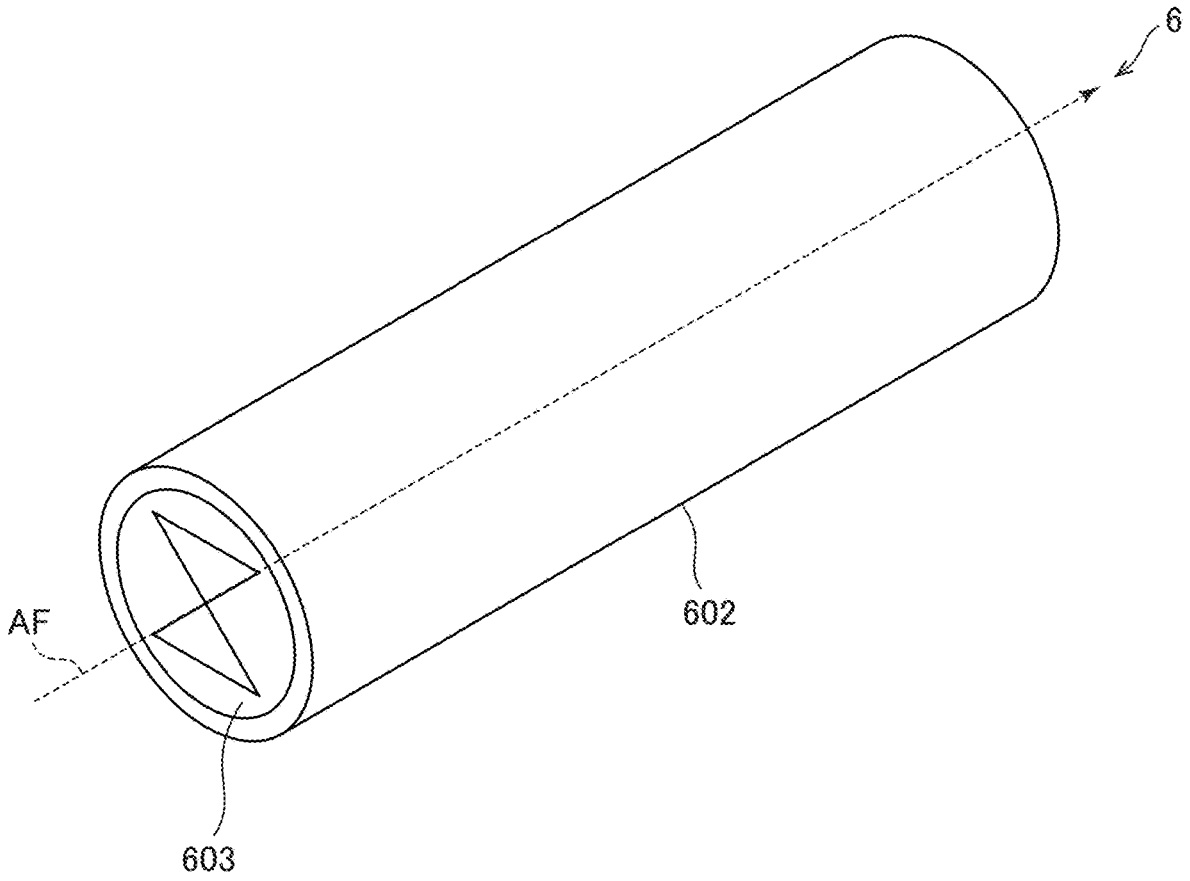
FIG. 24 is a perspective view schematically illustrating a non-heating type flavor sustained-release device of a sixth embodiment.
Figure 25:
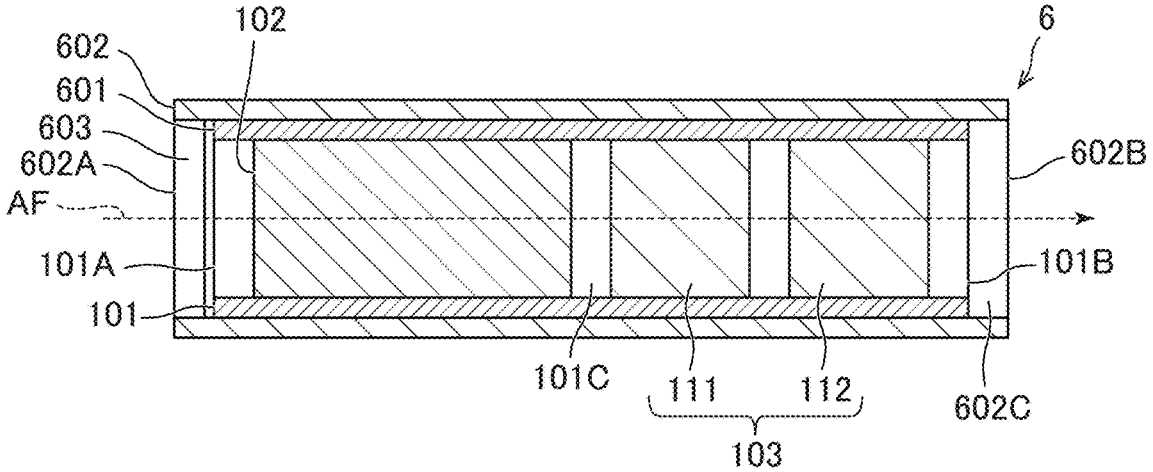
FIG. 25 is a cross-sectional view schematically illustrating the non-heating type flavor sustained-release device of the sixth embodiment.

FIG. 24 is a perspective view schematically illustrating a non-heating type flavor sustained-release device of a sixth embodiment. FIG. 25 is a cross-sectional view schematically illustrating the non-heating type flavor sustained-release device of the sixth embodiment.

As illustrated in FIGS. 24 and 25, a non-heating type flavor sustained-release device 6 of the sixth embodiment includes: a non-heating type flavor component emission device 601; a cylindrical holder 602; and an air blowing device 603.

The non-heating type flavor component emission device 601 is the non-heating type flavor component emission device 1 of the first embodiment, the non-heating type flavor component emission device 2 of the second embodiment, the non-heating type flavor component emission device 3 of the third embodiment, or the non-heating type flavor component emission device 4 of the fourth embodiment. Alternatively, the non-heating type flavor component emission device 601 is a modification of one of the non-heating type flavor component emission devices 1 to 4. The non-heating type flavor component emission device 601 is a replaceable cartridge attached to, and detached from, the cylindrical holder 602.

The cylindrical holder 602 is shaped into a cylinder. Hence, the cylindrical holder 602 is provided with an inlet 602A, an outlet 602B, and a housing space 602C.

The housing space 602C extends from the inlet 602A to the outlet 602B. Hence, the air flow AF enters the housing space 602C through the inlet 602A. Then, the air flow AF is guided by the housing space 602C from the inlet 602A to the outlet 602B, and exits the housing space 602C through the outlet 602B.

The housing space 602C houses the non-heating type flavor component emission device 601.

The air blowing device 603 is disposed along the inlet 602A. The air blowing device 603 forms the air flow AF. The air blowing device 603 may also be disposed along the outlet 602B.

These features allow the air flow AF containing a flavor component to exit from the outlet 602B, such that the flavor component is sustained-released. Hence, the non-heating type flavor sustained-release device 6 can provide the user with physical and mental relaxation, better health, and cosmetic improvement. Moreover, the non-heating type flavor component emission device 601 is replaced with another one, and the user can enjoy various flavor components.

The present disclosure shall not be limited to the above-described embodiments, and may be replaced with a configuration substantially the same as, a configuration having the same advantageous effects as, or a configuration capable of achieving the same object as, the configurations described in the above-described embodiments

The invention claimed is:

1. A non-heating type flavor component emission device, comprising:

a hollow casing provided with a first opening, a second opening, and a flow path guiding an air flow from the first opening to the second opening;

a water retainer disposed in the flow path, retaining water, and configured to emit the water into the air flow; and an emitter disposed in the flow path closer to the second opening than to the water retainer, and configured to emit a flavor component into the air flow, wherein the emitter includes:

an absorber containing a water absorbing material;

a moisture control component containing salt that forms hydrate crystals within a relative humidity range of 30% RH or more and 80% RH or less, the moisture control component being contained in the water absorbing material and configured to absorb and emit water; and the flavor component.

2. The non-heating type flavor component emission device according to claim 1, wherein the salt contains metal salt that forms hydrate crystals within a relative humidity range of 30% RH or more and 80% RH or less.

3. The non-heating type flavor component emission device according to claim 1, wherein the salt contains carboxylic acid salt.

4. The non-heating type flavor component emission device according to claim 1, wherein the salt contains at least one selected from the group consisting of sodium formate, sodium acetate, and sodium propionate.

5. The non-heating type flavor component emission device according to claim 1, wherein the water retainer contains at least one selected from the group consisting of a water-absorbing resin and a porous solid that retains the water by capillarity.

6. The non-heating type flavor component emission device according to claim 1, further comprising a separating plate attached to, and detached from, an interior of the flow path, and separating the water retainer from the emitter when attached to the interior of the flow path.

7. The non-heating type flavor component emission device according to claim 1, wherein the water retainer contains the water.

8. The non-heating type flavor component emission device according to claim 1, wherein the emitter is a first emitter, the flavor component is a first flavor component, and the water retainer is a second emitter configured to emit a second flavor component into the air flow.

9. The non-heating type flavor component emission device according to claim 1, wherein the emitter includes a plurality of emission materials each emit a corresponding one of a plurality of flavor components into the air flow.

10. The non-heating type flavor component emission device according to claim 9, wherein the plurality of emission materials are arranged in a direction in which the flow path extends, each of the plurality of emission materials has a threshold humidity, if a relative humidity is higher than the threshold humidity, each of the emission materials emits the corresponding one of the flavor components, and if the relative humidity is lower than the threshold humidity, each of the emission materials is kept from emitting the corresponding one of the flavor components, and as an emission material contained in the plurality of emission materials is positioned more downstream of the air flow, a threshold humidity of the emission material increases.

11. The non-heating type flavor component emission device according to claim 1, wherein the hollow casing includes a transparent window disposed along the emitter.

12. A non-heating type flavor inhaler, comprising:

the non-heating type flavor component emission device according to claim 1; and a cylindrical holder provided with an inlet through which the air flow enters, an outlet through which the air flow exits, and a housing space extending from the inlet to the outlet and housing the non-heating type flavor component emission device, the cylindrical holder including a mouthpiece portion provided with the outlet.

13. A non-heating type flavor sustained-release device, comprising:

the non-heating type flavor component emission device according to claim 1;

a cylindrical holder provided with an inlet through which the air flow enters, an outlet through which the air flow exits, and a housing space extending from the inlet to the outlet and housing the non-heating type flavor component emission device; and a forming mechanism disposed along the inlet or the outlet, and configured to form the air flow.

* * * * *